US011698208B2

(12) United States Patent
Patel et al.

(10) Patent No.: US 11,698,208 B2
(45) Date of Patent: Jul. 11, 2023

(54) FRESH AIR DISTRIBUTION SYSTEM FOR PACKAGED TERMINAL AIR CONDITIONER

(71) Applicants: Henry I. Patel, Lubbock, TX (US); Aviraj H. Patel, Lubbock, TX (US); Niraj H. Patel, Lubbock, TX (US)

(72) Inventors: Henry I. Patel, Lubbock, TX (US); Aviraj H. Patel, Lubbock, TX (US); Niraj H. Patel, Lubbock, TX (US)

( * ) Notice: Subject to any disclaimer, the term of this patent is extended or adjusted under 35 U.S.C. 154(b) by 506 days.

(21) Appl. No.: 16/850,754

(22) Filed: Apr. 16, 2020

(65) Prior Publication Data

US 2020/0333036 A1 Oct. 22, 2020

Related U.S. Application Data

(60) Provisional application No. 62/834,758, filed on Apr. 16, 2019.

(51) Int. Cl.

| | |
|---|---|
| ***F24F 13/02*** | (2006.01) |
| ***F24F 13/04*** | (2006.01) |
| ***F24F 11/74*** | (2018.01) |
| *F24F 11/00* | (2018.01) |

(52) U.S. Cl.

CPC ..... *F24F 13/0236* (2013.01); *F24F 11/74* (2018.01); *F24F 13/04* (2013.01); *F24F 2011/0002* (2013.01)

(58) Field of Classification Search

CPC ..... F24F 13/0236; F24F 13/04; F24F 11/74; F24F 2011/0002

USPC ..... 454/284

See application file for complete search history.

(56) References Cited

U.S. PATENT DOCUMENTS

| | | | | |
|---|---|---|---|---|
| 3,666,002 | A | 5/1972 | Ferdelman | |
| 5,318,474 | A * | 6/1994 | Klassen | F24F 13/068 454/296 |
| 5,992,160 | A | 11/1999 | Bussjager et al. | |
| 6,009,716 | A | 1/2000 | Aoto et al. | |
| 7,628,026 | B1 | 12/2009 | Kritsky et al. | |
| D618,777 | S | 6/2010 | Kritsky | |
| 8,757,506 | B2 | 6/2014 | Zhou et al. | |
| 9,383,115 | B2 | 7/2016 | Siegel et al. | |
| 9,696,044 | B2 | 7/2017 | Shaffer et al. | |
| 2005/0224591 | A1 | 10/2005 | Wolfson | |
| 2006/0035580 | A1 | 2/2006 | Anderson et al. | |
| 2006/0199505 | A1* | 9/2006 | Fettkether | F24F 13/0236 454/232 |
| 2008/0051024 | A1 | 2/2008 | Caliendo et al. | |
| 2008/0148749 | A1 | 6/2008 | Ishida | |
| 2008/0230619 | A1 | 9/2008 | Kirby | |

(Continued)

*Primary Examiner* — Avinash A Savani
*Assistant Examiner* — Dana K Tighe
(74) *Attorney, Agent, or Firm* — Monty L Ross PLLC; Monty L Ross

(57) ABSTRACT

A fresh air distribution system designed for PTAC use, the system comprising a first upwardly directed air distribution duct configured to receive a stream of pressurized fresh air discharged from a fresh air blower apparatus and to redirect the stream into a transversely extending second air distribution duct communicating with the first air distribution duct, the second air distribution duct comprising a plurality of laterally spaced baffles angularly disposed inside the duct that divide and redirect the stream into an inside plenum of the PTAC to be combined with recirculated in-room air.

4 Claims, 3 Drawing Sheets

(56) References Cited

U.S. PATENT DOCUMENTS

| | | | | |
|---|---|---|---|---|
| 2014/0330438 | A1 | 11/2014 | Haines et al. | |
| 2015/0107802 | A1* | 4/2015 | Ulmanen ..... | F24F 13/26<br>165/120 |

* cited by examiner

FRESH AIR DISTRIBUTION SYSTEM FOR PACKAGED TERMINAL AIR CONDITIONER

1. FIELD OF THE INVENTION

This invention relates to a fresh air distribution system useful in a packaged terminal air conditioner (PTAC). A blower apparatus desirably receives fresh air from the outdoor environment through a specially configured intake housing and duct assembly, pressurizes the fresh air and then discharges the air into the subject fresh air distribution system to be combined with air that is recirculated inside an identified space in which the indoor section of the PTAC is installed in accordance with applicable building codes and regulations. The subject system receives and directs pressurized, preferably pretreated, fresh air discharged by the blower apparatus through flow transitions including vertical lift, horizontal redirection, lateral spread, and downward redirection to combine the fresh air with recirculated air inside the PTAC.

2. DESCRIPTION OF RELATED ART

Air conditioner systems, apparatus, methods and designs are disclosed in at least the following United States patents and publications: U.S. Pat. Nos. 3,666,002; 5,992,160; 6,009,716; 7,628,026; 8,757,506; 9,383,115; 9,696,044; D618,777; 2005/0224591; and 2008/0230619.

SUMMARY OF THE INVENTION

A fresh air distribution system is disclosed for use inside a PTAC for the purpose of lifting and redirecting a stream of pressurized fresh air discharged from a fresh air blower apparatus vertically upwards and then horizontally to divide and spread the fresh air stream before discharging it downwardly into an inside plenum of the PTAC, where the fresh air is combined with recirculated air entering the inside plenum from an identified interior space in which the PTAC is installed. The subject fresh air distribution system comprises a plurality of connected duct sections that provide the path for air movements. The stream of pressurized fresh air is desirably redirected through at least two perpendicular bends before being combined with inside air being recirculated by the PTAC. This fresh air distribution system can also be modified for use in other types of air-conditioners.

As used herein, the term "perpendicular bend" refers to an air duct configuration in which the principal direction of travel of the pressurized air stream changes perpendicularly, even though the "perpendicular bend" may have a radius of curvature configured to reduce pressure drop through the bend. As used herein, "pretreated" or "pretreatment" refers to any process such as screening, filtration, ultrafiltration, sterilization, purification, ionization, electrostatic precipitation, electric heating, and the like, that is performed on the stream of fresh air entering the PTAC before the air stream reaches the fresh air distribution system of the invention. Air temperature and humidity sensors can also be provided inside the air intake housing to provide data input to the PTAC controller for use in determining blower speed and thereby controlling the fresh air flow rate through the fresh air distribution system.

In one embodiment of the invention, a specially configured (preferably metallic) fresh air intake housing provides air entry into the fresh air blower apparatus and air distribution system network. This first section is sufficiently durable to withstand harsh outdoor environmental conditions and desirably includes an inlet port with a cross-sectional area that does not contribute to backpressure or significantly impede air flow while passing through any pretreatment section prior to entering the suction side of the fresh air blower apparatus. Lessening resistance to air flow upstream of the blower apparatus also lowers the electrical energy demand for the fresh air blower apparatus.

The duct section of the fresh air distribution system that communicates with the outlet port of the fresh air blower apparatus can be metallic but is desirably configured of plastic material that is moldable, lighter in weight than metal and has low frictional resistance to air flow to facilitate lifting the pressurized fresh air stream to a higher position in the PTAC for better air distribution into the inside plenum of the PTAC. The last section of the fresh air distribution system is desirably metallic to assist with the heat recovery function of the unit and comprises a plurality of baffles to help provide even air distribution across the width of the inside plenum of the PTAC as the fresh air exits the fresh air distribution system to be combined with the recirculated "in room" air that is drawn into the inside plenum by the air recirculation fan of the PTAC. Details of these embodiments are set forth in the accompanying drawings. Other features will be apparent from the description, drawings and from the claims.

BRIEF DESCRIPTION OF THE DRAWINGS

The apparatus of the invention is further described and explained in relation to the following drawings wherein.

DESCRIPTION OF THE PREFERRED EMBODIMENTS

Figure 1:
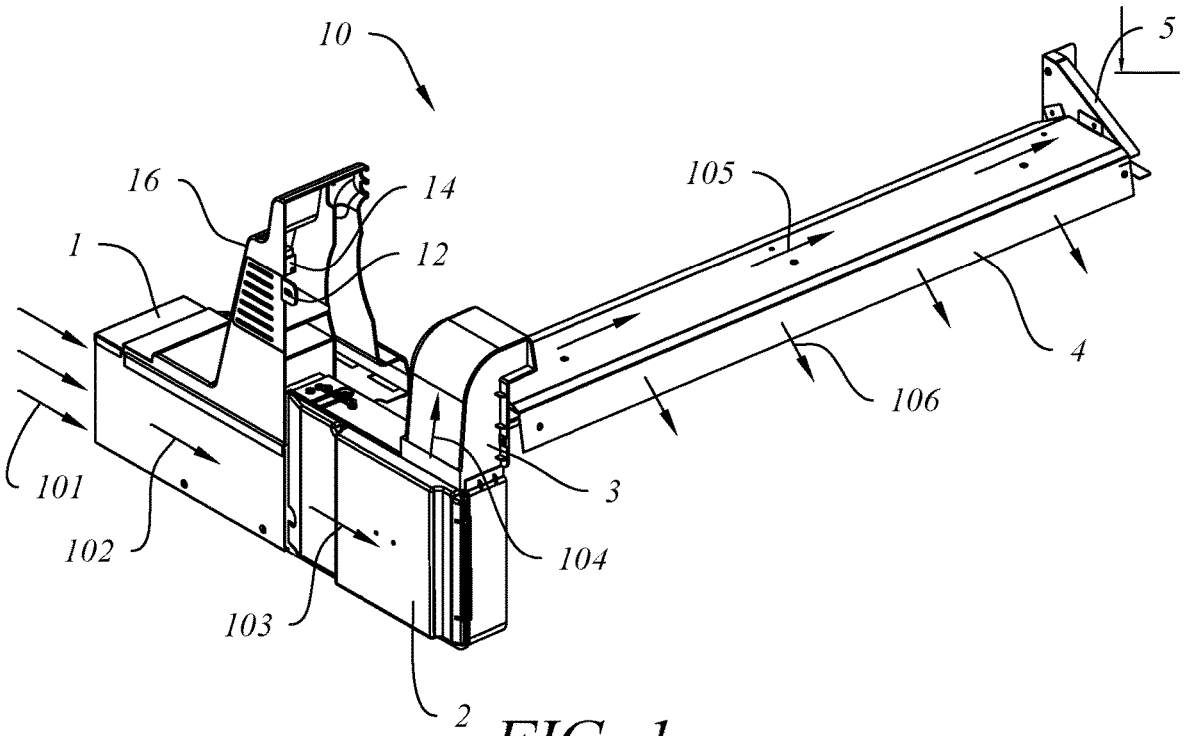
FIG. 1 is a rear perspective of one embodiment of the fresh air intake, blower and fresh air distribution system of the invention.
Figure 2:
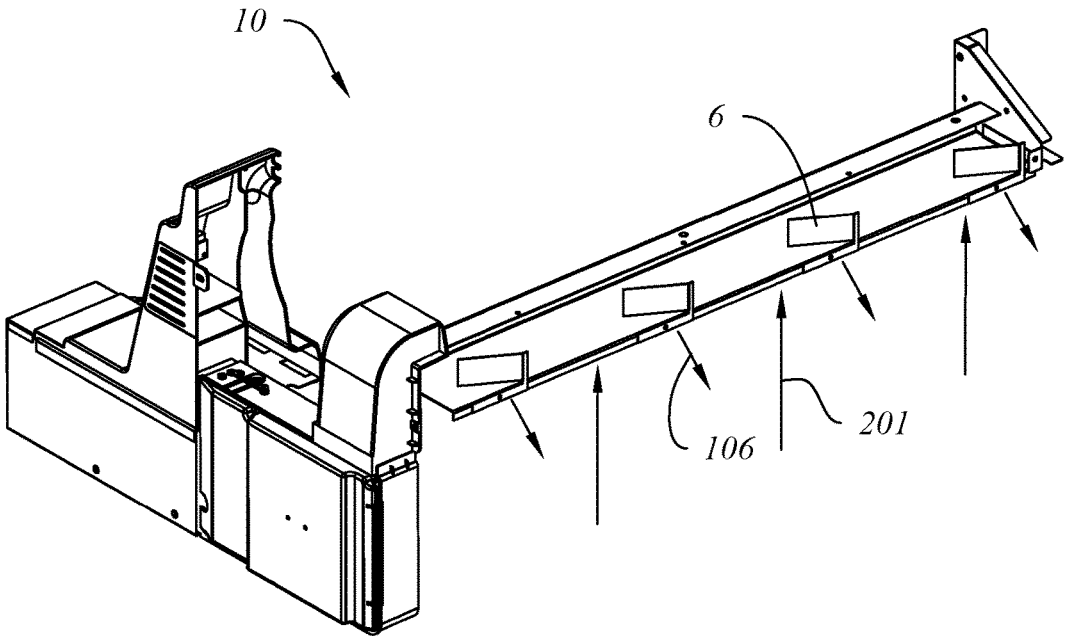
FIG. 2 is another rear perspective view of the embodiment of FIG. 1, with a cover removed to make the internal baffles visible.

FIG. 1 illustrates a rear perspective view of one embodiment of fresh air distribution system 10 comprising inlet housing 1, blower housing 2, air lift housing 3, fresh air outlet duct 4, and end cover plate 5. FIG. 2, with the cover removed, diagrammatically illustrates a plurality of spaced-apart, air directional deflectors 6. FIG. 1 also has diagrammatic arrows 101, 102, 103, 104, 105 and 106 illustrating the air flow path through fresh air distribution system 10.

Arrow 101 of FIG. 1 shows the principal flow direction of fresh (outside) air entering into the air distribution network. Arrow 102 shows the principal flow direction of air traveling through housing 1. Arrow 103 shows the principal flow direction of air traveling through the fresh air sensing and pretreating section upstream of the fresh air blower apparatus concealed by blower housing 2. Arrow 104 shows the principal flow direction of air being discharged from blower housing 2 into air lift housing 3. Arrows 105, downstream show the principal flow direction of fresh air passing through fresh air outlet duct 4. Arrows 106 show the principal flow direction of the stream of pressurized fresh air as it is distributed across the width of fresh air outlet duct 4 and then deflected by spaced-apart baffles 6 to flow downwardly and outwardly into the interior space of the inside plenum of a PTAC.

In FIG. 2, arrows 201 depict schematically how fresh air exiting fresh air outlet duct 4 as shown by arrows 106 are combined with the counter-current flow of recirculated in-room air (as shown by arrows 201) entering the PTAC. It will be appreciated, of course, by those skilled in the art reading this disclosure that the arrows referred to above depict the principal air flow direction, whereas the actual air flow will also contain zones of turbulent flow and eddy currents (not shown in the simplified drawings) when the air stream contacts duct walls, covers, baffles and countercurrent air flows.

Portions of the duct sections of fresh air distribution system 10 that are metallic will also function to transfer heat across any temperature gradient that exists between the fresh air stream and the duct surfaces, or between the fresh air stream and any recirculated air stream with which it comes into contact before being thoroughly intermixed by the overall air flow through the inside portion of the PTAC. Depending upon the mode of operation of the PTAC, this is sometimes referred to as "heat recovery."

Figure 3:
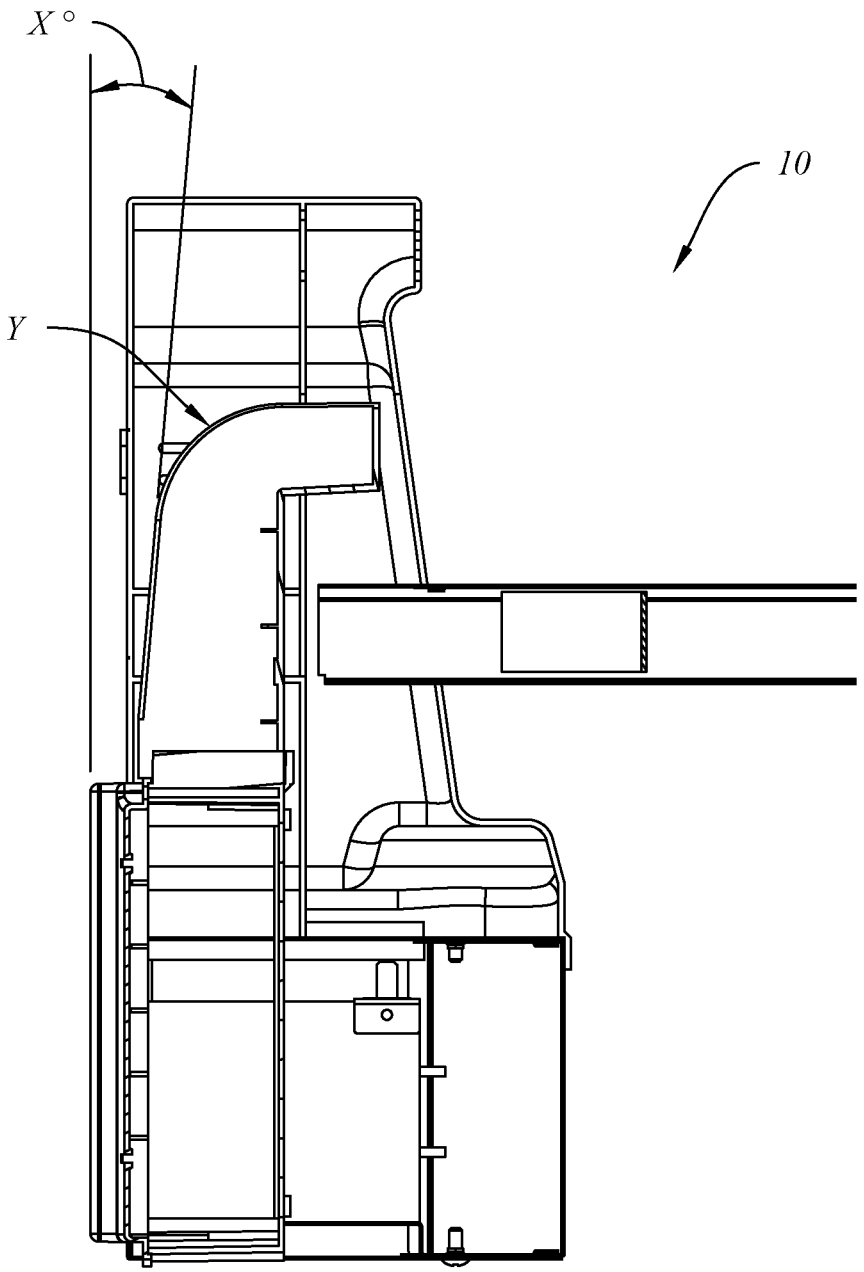
FIG. 3 is an enlarged front elevation view of the embodiment of FIG. 1.

Referring to FIGS. 1 and 3, in accordance with one preferred embodiment of the invention, the outwardly facing surface of perpendicular bend Y of air distribution system 10 desirably has a tapered angle of 4-6 degrees as indicated by "X°" in FIG. 3 to assist in guiding air through to fresh air outlet duct 4 (FIG. 1). Also in relation to FIG. 3, the significantly larger radius of curvature "Y" reduces air turbulence as the fresh air stream flows into fresh air outlet duct 4.

Figure 4:
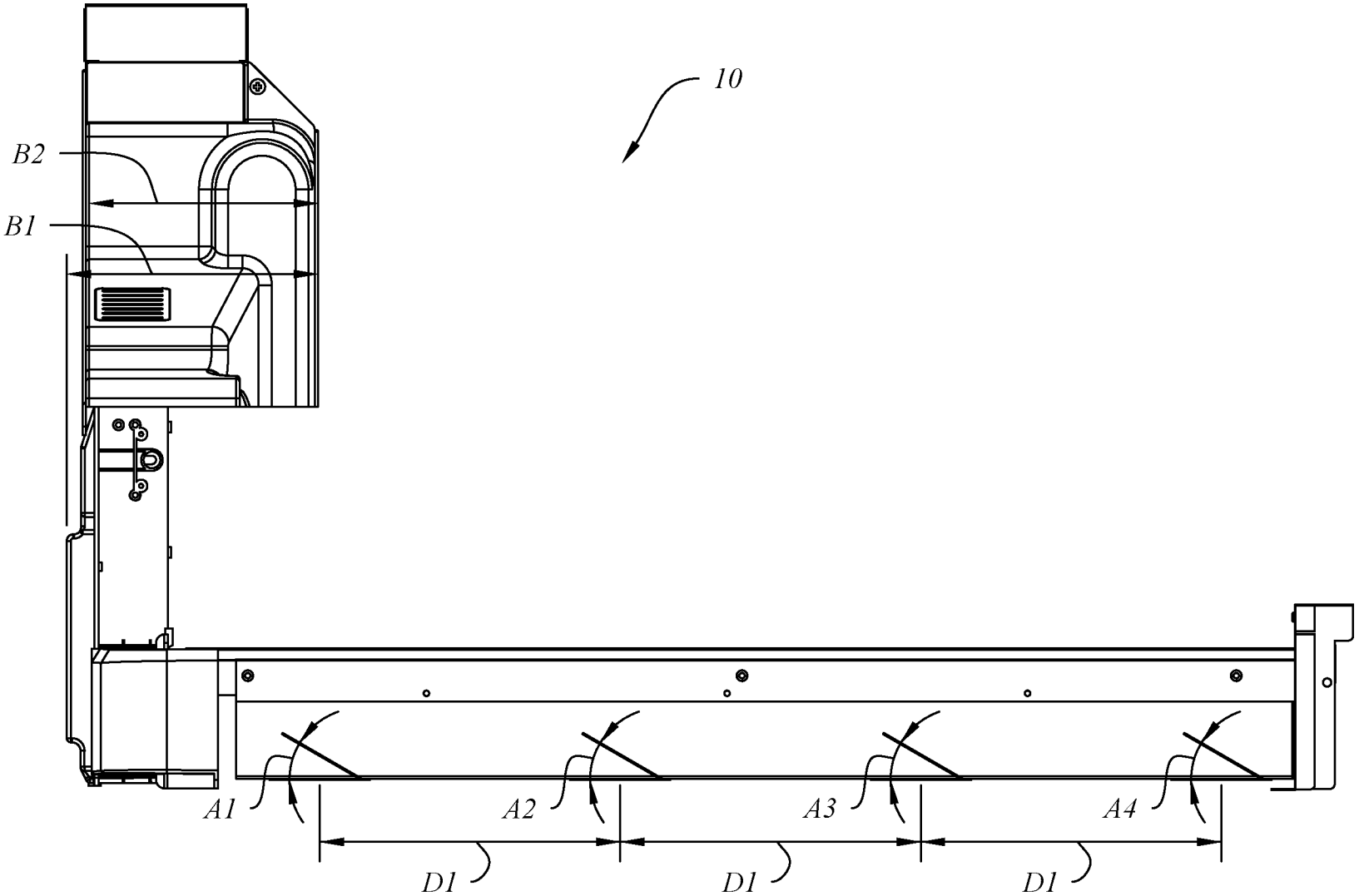
FIG. 4 is a top plan view of the embodiment of FIG. 1.

Referring to FIGS. 1 and 4, in accordance with another preferred embodiment of the invention, fresh air flow into fresh air blower housing 2 is improved where the value of B1 to B2 is a 10% increase.

Referring to FIGS. 1, 2 and 4, air deflectors 6 assist in establishing more even air distribution into the interior space and are desirably evenly spaced along fresh air outlet duct 4 (FIG. 1) as shown by the spacing "D1" in FIG. 4.

Referring to FIGS. 1 and 4, air deflectors 6 are also desirably angled to allow air to be distributed downwardly and outwardly into the interior space in the inside plenum of the PTAC. As shown in FIG. 4, air deflectors 6 are preferably angled increasingly in sequence across fresh air outlet duct 4 starting from the one nearest fresh air blower apparatus to the one nearest end cover 5 at fixed angle A1 with each subsequent air deflector 6 positioned at an angle enlarged by 5 degrees, e.g. A1; A2=A1+5 degrees; A3=A2+5 degrees; and A4=A3+5 degrees.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventors are legally entitled.

What is claimed is:

1. A fresh air distribution system for PTAC use, the system comprising a first upwardly directed air distribution duct disposed downstream of a fresh air blower apparatus and configured to receive a stream of pressurized fresh air discharged from the fresh air blower apparatus and to redirect the stream into a transversely extending second air distribution duct communicating with the first air distribution duct, the second air distribution duct comprising a plurality of laterally spaced fresh air deflectors angularly disposed inside the duct, wherein the plurality of fresh air deflectors are evenly spaced apart laterally across a width of the PTAC to divide and redirect the stream into an inside plenum of the PTAC to be combined with recirculated in room air.

2. The fresh air distribution system of claim 1 wherein each successive fresh air deflector is disposed at a slightly greater angular orientation relative to the flow direction to assist in balancing fresh air flow across the width of the PTAC.

3. A fresh air distribution system for PTAC use, the system comprising a first upwardly directed air distribution duct disposed downstream of a fresh air blower apparatus and configured to receive a stream of pressurized fresh air discharged from the fresh air blower apparatus and to redirect the stream into a transversely extending second air distribution duct communicating with the first air distribution duct, the second air distribution duct comprising a plurality of laterally spaced fresh air deflectors angularly disposed inside the duct that divide and redirect the stream into an inside plenum of the PTAC to be combined with recirculated in room air, wherein a damper is disposed between the fresh air intake section and the fresh air blower apparatus and is normally open during use of the PTAC.

4. The fresh air distribution system of claim 3 wherein a fresh air flow rate into the PTAC is controlled by a fresh air blower speed whenever the damper is open.

* * * * *